US005252958A

United States Patent [19]

Daniels

[11] Patent Number: 5,252,958

[45] Date of Patent: Oct. 12, 1993

[54] METHOD AND APPARATUS FOR INTERSPECIES COMMUNICATION

[76] Inventor: John J. Daniels, 350 Bristol St., Unit A-1, Waterbury, Conn. 06708

[21] Appl. No.: 755,057

[22] Filed: Sep. 5, 1991

[51] Int. Cl.[5] ..... G09G 3/34

[52] U.S. Cl. ..... 345/107; 119/719; 119/905

[58] Field of Search ..... 340/787, 788, 729, 811, 340/716; 119/29; 359/53; 381/42, 43, 48; 434/156; 367/127-135

[56] References Cited

U.S. PATENT DOCUMENTS

| | | | |
|---|---|---|---|
| 3,760,406 | 9/1973 | Walton | 340/811 |
| 4,294,516 | 10/1981 | Brooks | 359/53 |
| 4,315,482 | 2/1982 | Cooper et al. | 119/29 |
| 4,418,346 | 11/1983 | Batchelder | 340/787 |
| 4,620,916 | 11/1986 | Zwemer et al. | 340/787 |
| 4,847,817 | 7/1989 | Au et al. | 367/135 |
| 5,012,452 | 4/1991 | Johnson et al. | 367/131 |
| 5,058,167 | 10/1991 | Kimura | 381/43 |
| 5,099,455 | 3/1992 | Parra | 367/127 |
| 5,113,272 | 5/1992 | Reamey | 340/716 |

OTHER PUBLICATIONS

"Computer Controlled Teaching Instrumentation for Linguistic Studies with Great Apes", IEEE Transactions on Computers, vol. C-25, No. 1, Jan. 1976.

"Fluids that thicken electrically", Theodore G. Duclos, Debra N. Acker, J. David Carlson reprint from Machine Design, Jan. 29, 1988.

"Material composition discrimination of cylinders at different aspect angles by echolocating dolphin", Whitlow W. L. Au and Charles W. Turl, J. Acoust. Soc Am., May, 1991.

*Primary Examiner*—Ulysses Weldon
*Assistant Examiner*—Gin Goon
*Attorney, Agent, or Firm*—John J. Daniels

[57] ABSTRACT

A method and apparatus is provided by which human and dolphin participants may actively progress towards a mutually understandable meaningful communication system. The apparatus includes a three dimensional grid matrix having X and Y electrode wires stacked on top of themselves to form the three dimensional grid. This three dimensional grid system is preferably enclosed in an electrical rheological fluid which is responsive to an electric potential applied across it. The three dimension grid matrix is driven so that selected pixels of the three dimensional grid are activated, and it is thus possible to memorialize or form a three dimensional image of an object or communicable symbols in the electrical rheological fluid. Column and row drivers are controlled by a central processing unit so as to define which pixels should be selectively activated to apply a potential to the electrical rheological fluid contained within the pixel to thereby solidify or vary the viscosity of the electrical rheological fluid in the selected pixels while the unselected pixels remain unchanged. The echolocation clicks and whistles of a dolphin can be inputted to the CPU where they are processed by comparing them to predetermined values to determine the selectivity of the pixels. In this way, the echolocation of the dolphin received by the CPU is used to selectively drive the row and column electrodes of the three dimensional grid system, thereby enabling the presentation of three dimensional image corresponding to the echolocation signals from the dolphin. This image may be perceived by both dolphin and human participants.

10 Claims, 6 Drawing Sheets

METHOD AND APPARATUS FOR INTERSPECIES COMMUNICATION

BACKGROUND OF THE INVENTION

The present invention pertains to a method and apparatus for interspecies communication. In particular, the present invention pertains to a method and apparatus in which human and dolphin participants may systematically arrive at a mutually understandable communication system through active feed-back and progressive learning.

There have been attempts to provide meaningful communication between two species. Particularly, conventional attempts have included trying to teach, for example, chimpanzees or apes a sign language which can be understandable by the chimp or ape and by the human participant. However, these attempts at teaching sign language have been failures except in the respect of teaching the animal through rote learning how to mimic certain hand positions in response to external stimuli.

There have also been attempts to communicate with the dolphin species. These attempts include trying to teach captive dolphins to indicate a particular symbol among a choice of symbols in response to stimuli. However, like the hand signals taught to the chimpanzees and apes, this communication is also at best a very rudimentary level and provides little more than rote learning by the dolphin. Furthermore, the prior art lacks any means by which the dolphins may receive feed-back in the form of stimuli which is particularly suited to the dolphin brain communication structures. In addition, the prior attempts have all failed to recognize that any attempt at meaningful communication between the dolphin and human species must require that an apparatus be designed which provides feed-back which can be perceived by both the human and dolphin participants and which is adapted to progressively develop a mutually communicable language between the two species.

Traditionally, attempts have been made to communicate with dolphins. However, these attempts generally consisted of no more than mere rote training such as the memorization of simple symbols by the dolphins in return for which they were rewarded with a food morsel. However, in accordance with the theory underlying the present invention, a communication system must be developed predicated on the possibility that the dolphin species is capable of meaningful and complex communication between individual members of the dolphin species.

If one supposes that dolphins do perform meaningful and complex communication within their own species, then the next question which must be answered is, in what form does this communication take? The present invention is intended to provide a means for exploring the possibility that dolphin communicate intraspecies using a communication system which evolved in an environment which is very much unlike the environment in which the human species developed communication. Therefore, it is necessary to look for clues to the development of the dolphin intraspecies communication by first looking at the physical structures of the dolphin animal in conjunction with the environment in which it lives and in which it has evolved.

The phonemes which are the foundation of human vocal communication and from which human language is constructed probably would not have evolved in the underwater communication system of the dolphins. For example, the human brain structure evolved in an environment in which actions and events are memorialized at least temporarily. A simple example of this is a pair of footsteps on a barren beach along a low tide line. An observer may come along after the perpetrator of the footprints has vanished from sight and the observer will still notice the footprints. By this observation, the observer can quickly deduce that a being had been present on the beach prior to his coming there and left the footprints. However, after high tide there will be no such clues and there will be no circumstantial evidence from which to deduce the existence of the footprint perpetrator.

In stark contrast to the evolution of the human brain, the dolphin brain evolved in an environment in which the memorialization of activities and actions simply does not occur, even temporarily. The fluid, corrosive and ever changing conditions of the oceans forced the dolphin brain to evolve in circumstances very different in many regards from human development. Therefore, one must look at the evolution of communication in the dolphin species first by considering the environment in which the evolution took place.

It is well known that dolphins echolocate in order to perceive aspects of their environment. Through this echolocation, an individual dolphin can sense structures presented before him in the water just as humans can see structures on land. However, through echolocation, a much broader range of sensory information is available to the dolphin to be deciphered by its brain to derive certain attributes of the observed object which is being echolocated. For example, if a sealed plastic bag, which is optically opaque, and which contains a doll shaped like a human baby, is thrown into a tank with a dolphin, the dolphin would be able to echolocate the sealed bag and determine many attributes of both the bag and the contents inside. For example, from the information provided to the dolphin through echolocation, the dolphin may determine the bag's size, distance from the dolphin and what type of material the bag is made from. Furthermore, by tuning its echolocation the dolphin can determine the density and thickness of the bag by, for example, determining the permeability of the bag to acoustic signals of a certain range and noting the shape of the returning wave reflected by the bag. Remarkably, the dolphin is also able to determine the contents of the optically opaque bag. For example, by correctly tuning the clicks and whistles of its echolocation system, the dolphin can sonically pierce the veil of the opaque bag and perceive the contents inside. Upon the perception of the contents, the dolphin may be prompted to urge the bag containing the doll to the surface. However, more likely the dolphin will be able to distinguish the texture and density of the plastic doll from that of the living tissue of a human baby and decide that there is no danger.

Dolphins, therefore, have a perception of the world which is not experienceable by humans. Namely, the use of echolocations as one of its senses opens up a realm of information about its environment which is not duplicated by the senses available to humans.

One of the postulates of this theory is that the dolphin communication takes place on a level which provides much more information and much more detail about a particular subject than is possible through human verbal communication. The dolphin brain has evolved using a communication tool which relies heavily on graphical representation, such as texture, form, shape, etc. The complexity of the information which may be conveyed with such a communication system is staggering as compared with the limitations of the verbal communication system available to humans.

To explain this point, one may consider the information which is perceived when one views an abstract painting. By definition, such a painting will convey a multitude of meanings and feelings, emotions and images to the observer depending upon his own experience, sophistication and mood. However, if the same individual were to observe, for example, the Mona Lisa, he would note much of the same information as any of the millions of viewers of the Mona Lisa have throughout the centuries. For instance, he would quickly realize that the painting depicts an woman, he will note the color of her eyes, the shape of her face, etc. He may be able to deduce her ethnic origin, and so on. However, even such a descriptive painting is still very much open to interpretation and conjecture by the individual which will again be dependent of the experience and particular sophistication and mood of the individual with regards to the information that the Mona Lisa conveys to him. If, however, the same individual were to view a schematic drawing, for example, a blue-print of a house, much more information will be accessible to him which is common to other viewers and which was intended by the drawer. For example, most human individuals who view the blue-print will realize that it is a depiction of a building structure and may be able to determine many of the characteristics of the structure simply by looking at the blue-print. Furthermore, if the viewer is an architect and has experience with reading blue-prints, he will be able to decipher much more information in greater detail and with greater ease than the layman.

If one were to extrapolate this experience to the realm of dolphin communication it becomes readily apparent that the graphic-based communication tools which the dolphin has evolved to communicate present the potential intraspecies communication between members of the dolphin species with instantly understandable and vast amounts of information regarding their environment. Also, it is easy to see that such a communication can also convey vast amounts of historical significance as well as current environmental occurrences. Any attempt at communication between humans and dolphin will require that the communicating devices provide a means for the dolphin to memorialize a concept so that the human may study what has been memorialized in order to determine what that concept is.

A means by which the communication apparatus of the dolphin may be suitably utilized must first be developed to begin the development of a mutually understandable communication system. Therefore, a means must be provided by which the echolocation sonic signals of the dolphin communication may be memorialized.

SUMMARY OF THE INVENTION

The present invention is intended to provide a remedy. In accordance with the present invention, a method and apparatus is provided by which human and dolphin participants may actively progress towards a mutually understandable meaningful communication system. An object of the present invention is to provide a method by which the communication of the dolphin can be learned and understood by humans and by which the learning and understanding of the dolphin communication system progresses towards the development of a communication system which is mutually understandable by both human and dolphin participants.

In accordance with the inventive method and apparatus, a means and a method are provided for communication with dolphins. The means comprises a display means which consists of a three dimensional grid matrix having X and Y electrode wires stacked on top of themselves to form the three dimensional grid. This three dimensional grid system is submerged in an electrical rheological fluid which is responsive to an electric potential applied across it. When an electrical potential is applied through an electrical rheological fluid, the volume of the fluid which has the electrical potential applied through it becomes more viscous due to the alignment of particulates dispersed in the electrical rheological fluid. In accordance with the present invention, driving means are provided which are effective to drive the three dimension grid matrix so that selected pixels of the three dimensional grid are activated, and it is thus possible to memorialize or form a three dimensional solid image of an object or communicable symbols in the electrical rheological fluid. In other words, the three dimensional grid system forms three dimensional pixels which are selectively activated by column and row drivers of the driving means. These column and row drivers are controlled by a central processing unit so as to define which pixels should be selectively activated to apply a potential to the electrical rheological fluid contained within the pixel to thereby solidify the electrical rheological fluid in the pixel while the unselected pixels remain unchanged. The CPU has input means so that, for example, the echolocation clicks and whistles of a dolphin can be inputted to the CPU where they are processed by comparing them to predetermined values to produce the selectivity of the pixels. In this way, the echolocation signals of the dolphin taken from the input means is fed as information to the CPU to determine to selectively drive the row and column electrodes of the three dimensional grid system so as to present a three dimensional solid image corresponding to the echolocation signals from the dolphin.

The method involves isolating a dolphin in a tank and training it to echolocate an object. Then the dolphin is trained to communicate the echolocation of the object through signals of its communication apparatus, namely, the production of clicks and whistles. Once the dolphin learns to make a consistent click and whistle referring to the object, these clicks and whistles are recorded and digitized so that the digital information may be stored which corresponds to the dolphin's communication of its perception of a particular object. In other words, every time the dolphin echolocates a particular object, it will respond with a particular series of clicks and whistles which have some definable digital information which can be processed by the processing means. By selecting appropriate objects, for example, the shape of another dolphin, the shape of a human, and other shapes which the dolphin may be familiar with, such as sea turtles, sharks, etc., a catalogue of the corresponding clicks and whistles can be made which are digitized to create a vocabulary reference for the CPU.

After it has been preliminarily shown that the dolphin is capable of repetitiously echolocating an object and producing a consistent corresponding signal, which may be processed by the CPU, next a language can be developed which is mutually understandable between the human and dolphin species. It is readily foreseeable that once one dolphin is trained it will be instrumental in the training and teaching of other dolphins. Therefore, the speed at which the learning for both the human and participants in this experiment is accomplished should be continually increased. Thus, it is readily foreseeable that the feed-back means provided by the present invention will be utilized to promote a dialog between the species.

These objects and other objects, features, aspects, and advantages of the present invention will become more apparent from the following detailed description of the present invention when taken in conjunction with the accompanying drawings.

BRIEF DESCRIPTION OF THE DRAWINGS

FIG. 5(*b*) is a schematic view of the three dimensional grid system shown in FIG. 5(*a*);

FIG. 7(*b*) is an isolated view of a single activated pixel of the three dimensional grid system of an embodiment of the inventive apparatus for interspecies communication.

DETAILED DESCRIPTION OF THE DRAWINGS

Figure 1:
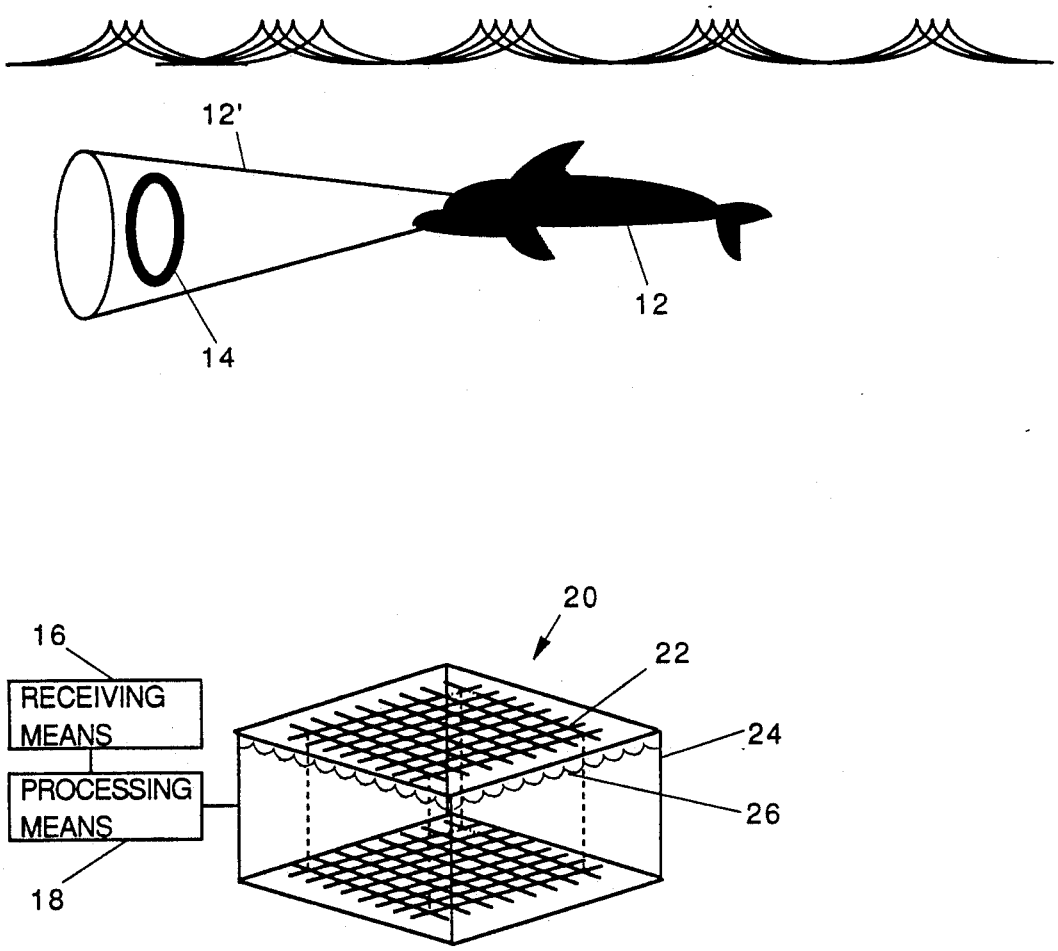
FIG. 1 is a view showing an embodiment of the inventive apparatus for interspecies communication in use.
Figure 2:
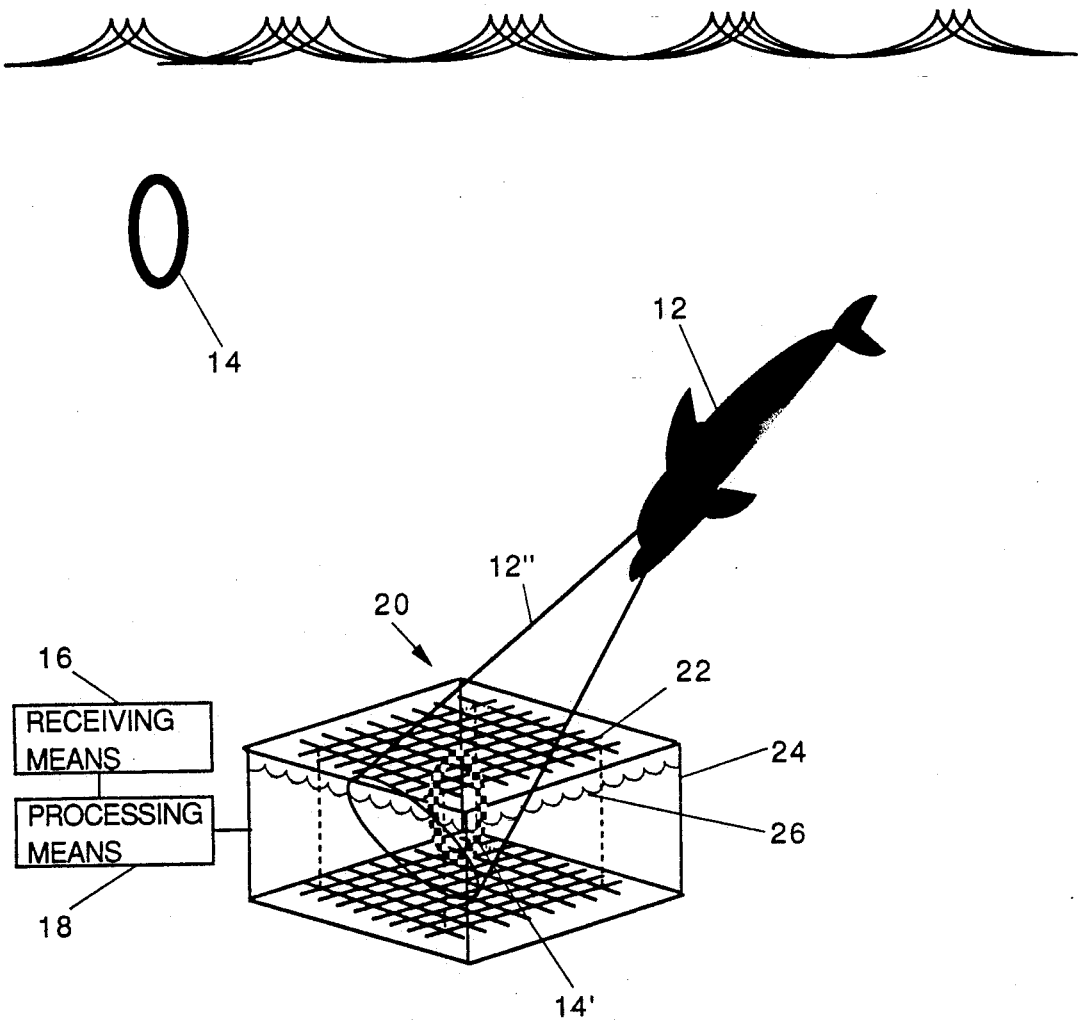
FIG. 2 is a view showing an embodiment of the inventive apparatus for interspecies communication in use.
Figure 3:
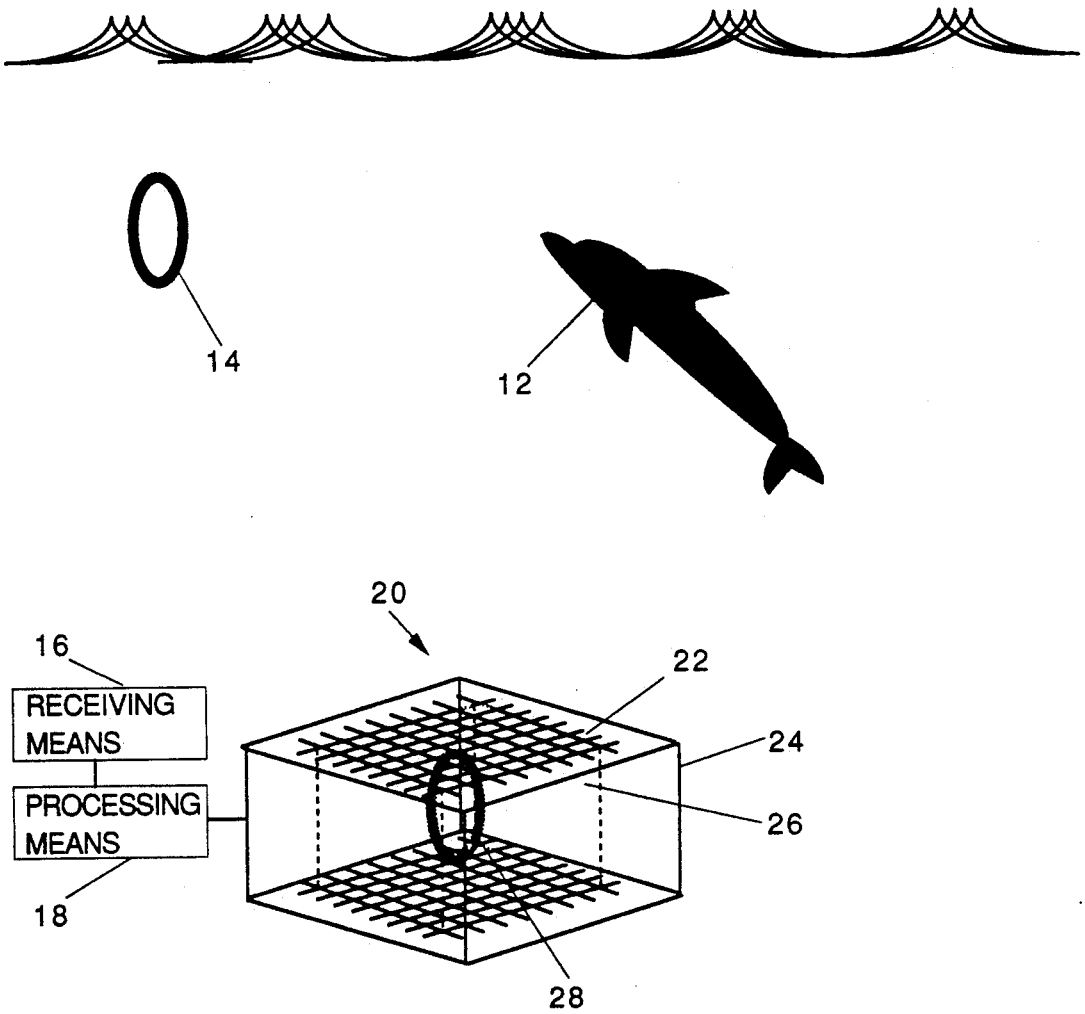
FIG. 3 is a view showing an embodiment of the inventive apparatus for interspecies communication in use.

Referring to FIGS. 1–3, the inventive apparatus for interspecies communication and method thereof will be described. In FIG. 1, a dolphin 12 is shown swimming in a tank of water and the dolphin 12 projects its echolocation signal 12' at a test object 14 included in the tank with the dolphin 12. The test object 14 is selected so that at the beginning stages of the learning process the dolphin 12 encounters an object having a simple geometric three dimensional shape (in this case a ring). At first, the test object 14 is selected as a simple geometrical shape such as the ring, so as to simplify the initial development of transposing the dolphins communication signals 12'' (shown in FIG. 2) into signals which can be recognized by a processing means 18 (described below). Thus, the basic geometric shapes initially selected provide a logical first step to deciphering the communication signals 12'' of the dolphin 12. It is noted that as the dolphin 12 begins to learn, and as the processing of the communication signals 12'' of the dolphin 12 by the inventive device become refined, more complicated shapes may be introduced as the test object 14 and it is contemplated that these shapes will initially take the shape of familiar objects in the dolphins environment, such as sea turtles, lobsters, fish, and the like.

In accordance with the present inventive method, the dolphin 12 echolocates the test object 14 as shown in FIG. 1. Also shown in FIG. 1 are receiving means 16 for receiving communication signals 12'' from the dolphin 12, processing means 18 for processing the communication signals 12'' to produce display driving signals in response thereto and display means 20 receptive of the display driving signals to display communicatable signals to the dolphin 12 and human participants to provide meaningful feed-back of the communication signals 12'' received from the dolphin 12. In this embodiment, the display means 20 comprises a three dimensional grid 22 of electrodes, containing means 24 for containing the three dimensional grid 22 and a characteristic variable fluid 26 (such as an electrical rheological fluid or fine magnetic particles which may be disposed in an oil) contained in the containing means 24 and surrounding the three dimensional grid 22.

As shown in FIG. 2, the dolphin 12 having echolocated the test object 14 is trained to remember the test object 14 and to project communication signals 12'' dependent on the remembered test object 14 to the receiving means 16. Note, that ideally the three dimensional grid 22 matrix has transponders which convert the communication signals (such as sonic signals produced by the dolphin 12) into signals such as electric signals which are deciphered, for example by the processing means 18, and which replicate an image of the test object 14 in the display means 20. In this way, the dolphin 12 will perceive that it has projected an image of the test object 14 at a location at which is then formed a three dimensional solid image 14' of the test object 14 which can be perceived by both the dolphin 12 and human participants. To accomplish the formation of the three dimensional solid image 14' of the test object 14, the display means 20 is constructed in such a way that spaces between electrodes comprising the three-dimensional grid system are utilized as three dimensional pixels to form a composite solid representation of the test object 14.

As shown in FIG. 3, once the dolphin 12 has communicated its perception of the test object 14 to the inventive apparatus, a memorialized solid image 28 of the test object 14 is retained in the display means 20 for perception by both the dolphin 12 and human participants. Thus, meaningful feed-back is established between test objects introduced into the dolphin's environment under the control of the human participant and the communication apparatus provides a means for the human and dolphin 12 to communicate. In other words, by progressively selecting, teaching and learning appropriate test objects, and by fine tuning the display of memorialized solid images of the test objects, which have been communicated by the dolphin 12, a method and means is provided in which the communication elements of the dolphin communication can be broken down and deciphered by the human participant to effect interspecies communication. Furthermore, it is contemplated that the dolphin 12 will systematically learn to alter its own communication signals 12'' so that the feed-back process may result in a speeding up of the bridging of the gap between the species to effect the interspecies communication.

Figure 4:
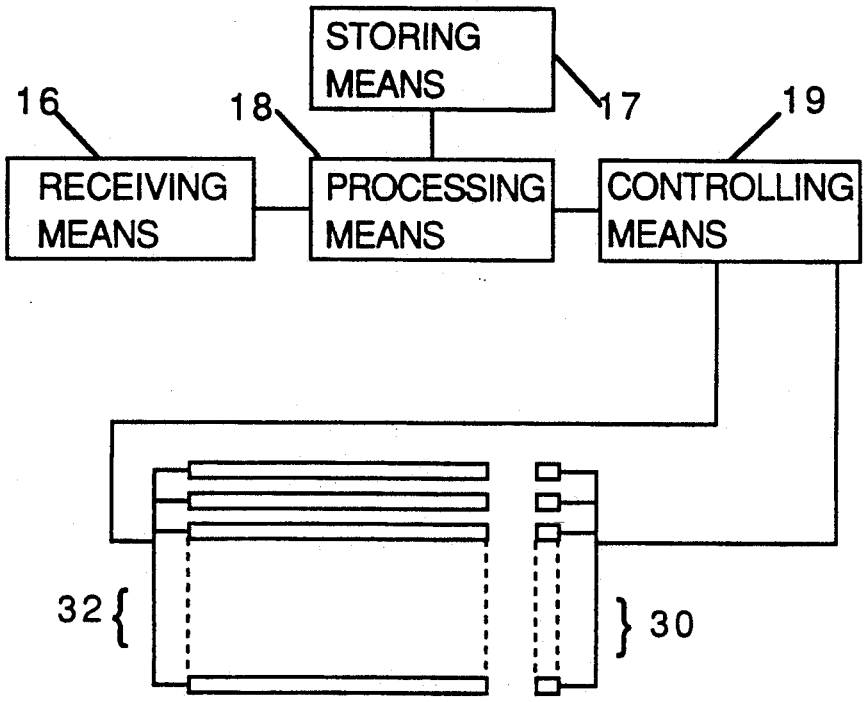
FIG. 4 is a schematic view of an embodiment of the inventive apparatus for interspecies communication.

Referring to FIG. 4, an embodiment of the inventive interspecies communication apparatus is schematically represented. In this embodiment, receiving means 16 receives the communication signal from the dolphin 12 and inputs these signals to the processing means 18 including a CPU. The processing means 18 processes these communication signals 12'' to produce the display driving signals in response thereto. Storing means 17 for storing data may be provided for comparing the data stored with the communication signals 12'' to produce the display driving signals. These display driving signals are inputted to controlling means 19 which controls X drivers 30 and Y drivers 32 for driving the X and Y electrodes of the three dimensional grid 22 system (shown in FIG. 5(*b*)). The three dimensional grid 22 system is constructed in such a way that the X electrodes 34 and Y electrodes 36 form three dimensional pixels in the viscosity variable fluid surrounding the three dimensional grid 22 system.

Figure 5A:
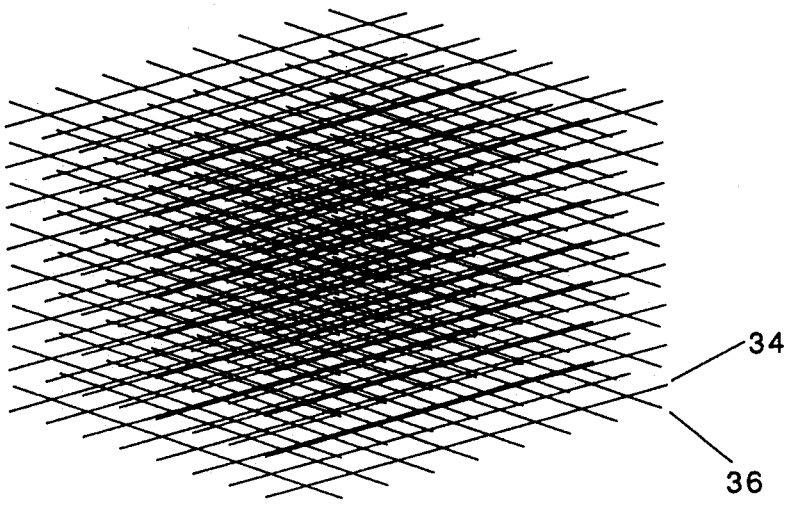
FIG. 5(*a*) is an isolated view of the three dimensional grid system of an embodiment of the inventive apparatus for interspecies communication.
Figure 5B:
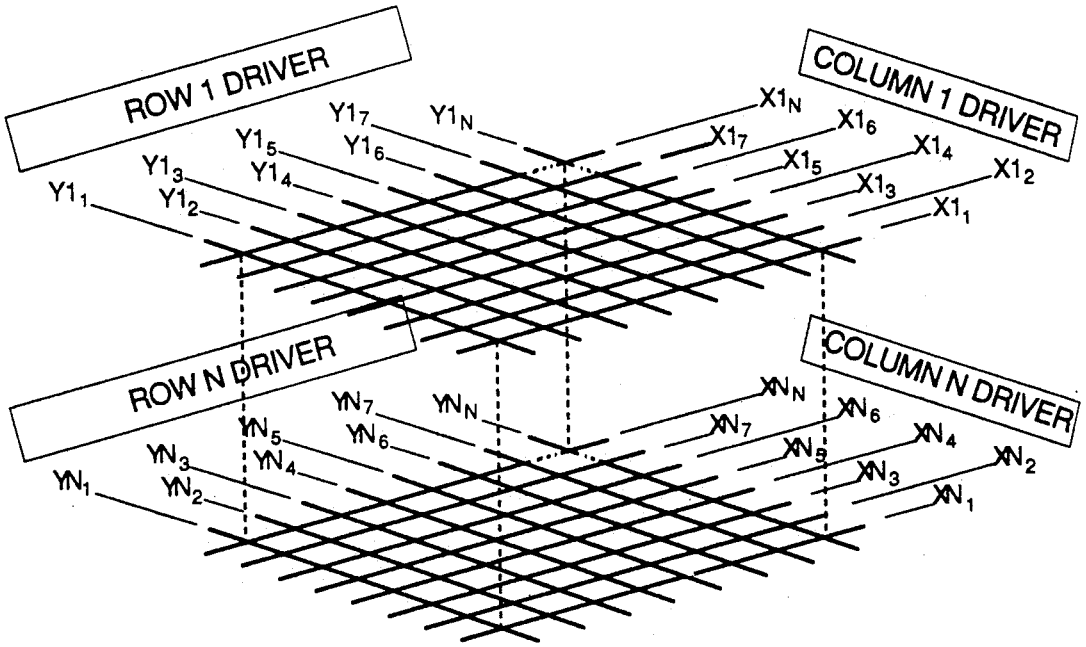

Referring to FIGS. 5(*a*) and 5(*b*), an embodiment of the three dimensional grid 22 system is shown. As shown in FIG. 5(*a*), the three dimensional grid 22 system is formed of a plurality of overlapping X and Y electrodes arranged to form three dimensional pixels in the space therebetween. This three dimensional grid 22 system is surrounded by a characteristic variable fluid 26 (for example, a viscosity variable fluid such as an electrical rheological fluid, magnetic particles dispersed in a fluid, a combination of the two, or the like) and is effective to memorialize a solid representation of an object by selectively applying a potential to particular pixels comprising the three dimensional grid 22 system. As shown in FIG. 5(*b*), the three dimensional grid 22 system comprises Y electrodes $Y1_1$ through $YN_N$ and X electrodes $X1_1$ through $XN_N$. It contemplated that the display means 20 may be comprised of other configurations such as a two-dimensional grid system in which one or two layers of X and Y electrodes may be disposed to provide the necessary pixels.

Figure 6:
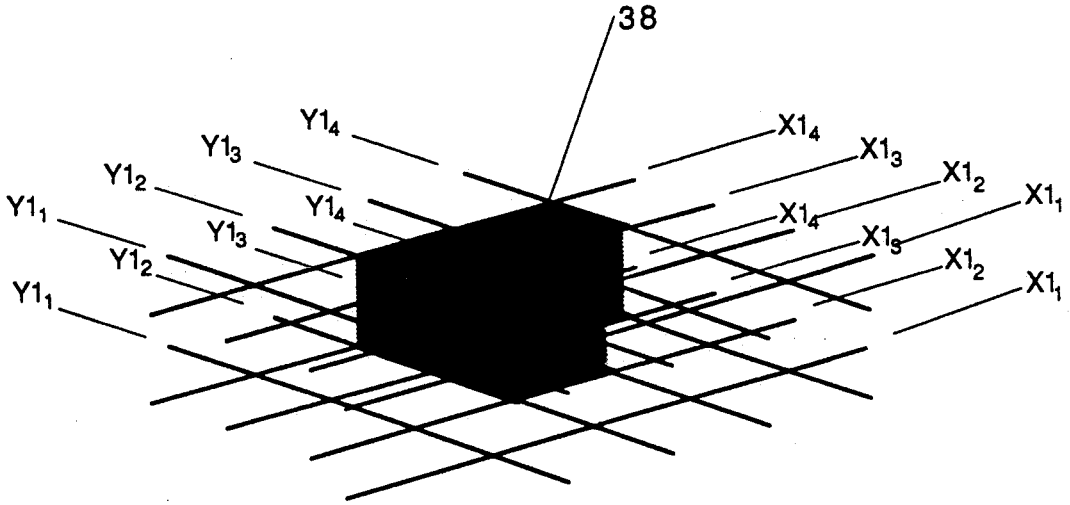
FIG. 6 is an isolated view of selected pixels of the three dimensional grid system of an embodiment of the inventive apparatus for interspecies communication.

Referring to FIG. 6, an isolated view of a section of the three dimensional grid 22 system is shown. In this case, a number of activated pixels 38 have been activated by selectively applying a potential between appropriate electrodes comprising the three dimensional grid 22 system so that the electrical rheological fluid disposed therebetween becomes solidified. In other words, by selectively applying a potential to appropriate X electrodes and Y electrodes of the three dimensional grid 22 system, a plurality of pixels may be activated to solidify the electrical rheological fluid contained therebetween to thus create a solid three dimensional image of an object composed of a composite of these solidified cubes of electrical rheological fluid contained in the particularly selected pixels.

Figure 7A:
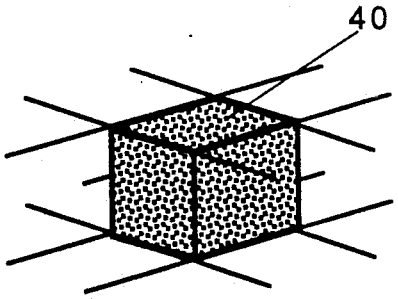
FIG. 7(*a*) is an isolated view of a single unactivated pixel of the three dimensional grid system of an embodiment of the inventive apparatus for interspecies communication.
Figure 7B:
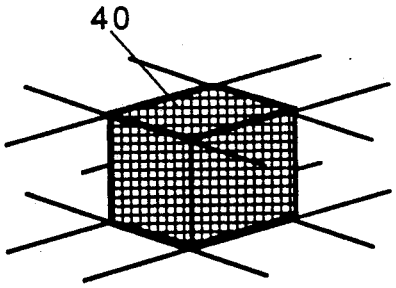

Referring to FIGS. 7(*a*) and 7(*b*), the phenomenon of electrical rheological fluid solidification will be described. In FIG. 7(*a*), an isolated view of a single pixel 40 is shown which is comprised of the four X electrodes and the four Y electrodes which may be selectively addressed so as to apply a potential to the electrical rheological fluid contained therebetween. When there is no potential applied to the electrical rheological fluid, the molecules of the particulates in the electrical rheological fluid are not aligned (i.e. the particulate is disposed randomly through-out the fluid) and the fluid has a relatively low viscosity. However, as shown in FIG. 7(*b*), when a potential is applied to the electrical rheological fluid, the particulates align themselves so as to form chains to thereby result in varying degrees of increased viscosity dependent on the potential and up to a solidification of the electrical rheological fluid. It is noted that the electrical rheological fluid is exceptionally responsive to the potential applied thereto so that a rapid and accurate solidification of particular pixels may be obtained to thereby provide nearly instantaneous feed-back to the dolphin 12 of the image projected by it of the three dimensional test image. The dolphin echolocation system is able to thus perceive the difference in the viscosity between the pixels and nearly instantaneously perceive positive feed-back of his communication attempts.

Thus, the three dimensional grid 22 system is submerged in the electrical rheological fluid. By selectively applying a potential to predetermined pixels made up of the X electrodes and Y electrodes, a desired image can be formed within the electrical rheological fluid. This image is composed of the distinction between selected pixels having a different viscosity as compared with non-selected pixels. This difference in viscosity is detectable by the dolphin's innate echolocation abilities.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

I claim:

1. An apparatus for interspecies communication, comprising:

receiving means for receiving acoustic communication signals from a dolphin;

processing means for processing the acoustic communication signals to produce display driving signals in response thereto; and displaying means comprising an electrical rheological fluid having at least an on state having a viscosity and an off state having a different viscosity dependent on an electric potential applied therethrough, and a three dimensional grid of intersecting electrodes, forming a plurality of pixels submerged in the electrical rheological fluid, the displaying means receptive of the display driving signals for displaying communicable symbols by selectively applying an electric potential to the electrodes so as to form an image comprised of portions of the electrical rheological fluid selectively disposed in either the on state or the off state so that the dolphin having an echolocation system is able to perceive the difference in the on state and off state between the pixels to perceive the image.

2. An apparatus for interspecies communication, comprising:

displaying means for displaying communicable symbols comprising an electrical rheological fluid having at least an on state having a viscosity and an off state having a different viscosity dependent on an electric potential applied therethrough, and a three dimensional grid of intersecting electrodes, forming a plurality of pixels submerged in the electrical rheological fluid, the displaying means receptive of display driving signals for displaying communicable symbols by selectively applying an electric potential to the electrodes so as to form an image comprised of portions of the electrical rheological fluid selectively disposed in either the on state or the off state so that a dolphin having an echolocation system is able to perceive the difference in the on state and off state between the pixels to perceive the image;

receiving means for receiving acoustic communication signals from a dolphin;

processing means for processing the acoustic communication signals to produce the display driving signals in response thereto; and controlling means receptive of the display driving signals for controlling the displaying means in response thereto.

3. A method of interspecies communication using the apparatus according to claim 2, the method comprising the steps of;

introducing a control object to be perceived by the dolphin;

receiving communication signals by the receiving means from the dolphin in response to the perception of the control object;

processing the communication signals by the processing means to produce the display driving signals;

controlling the display means by the controlling means so that the display means displays the communicable symbols dependent on the communication signals.

4. An apparatus for interspecies communication, comprising:

displaying means for displaying sonically detectable communicable symbols; a characteristic variable fluid disposed in the displaying means and having at least an on state having a viscosity and an off state having a different viscosity dependent on an applied field, the on state of the characteristic variable fluid having a different sonic perception by an echolocating animal species as compared with the off state of the characteristic variable fluid; applying means for applying the applied field to the characteristic variable fluid and effective for displaying the communicable symbols by selectively applying a field to discrete portions of the characteristic variable fluid so as to form a sonically perceivable image comprised of discrete portions of the characteristic variable fluid selectively disposed in either the on state or the off state, whereby the sonically detectable communicable signals may be perceived as the sonically perceivable image by an echolocating animal species.

5. An apparatus for interspecies communication according to claim 4; further comprising receiving means for receiving acoustic communication signals from an echolocating animal species; and processing means for processing the acoustic communication signals to produce the display driving signals in response thereto.

6. An apparatus for interspecies communication according to claim 4; wherein the applying means includes a grid of individually controllable field sources for applying the field to predetermined discrete portions of the characteristic variable fluid.

7. An apparatus for interspecies communication according to claim 6, wherein the grid of individual controllable field sources includes individual controllable electric potential sources.

8. An apparatus for interspecies communication according to claim 4, wherein the echolocating animal species is a dolphin; wherein the characteristic variable fluid is an electrical rheological fluid having at least an on state having a viscosity and an off state having a different viscosity dependent on an electric potential applied therethrough; and wherein the applying means comprises a three dimensional grid of intersecting electrodes forming a plurality of pixels submerged in the electrical rheological fluid and surrounding the discrete portions of the electrical rheological fluid, and the applying means further comprises controlling means in operable contact with each of the plurality of pixels for selectively applying an electric potential through the electrical rheological fluid disposed within each pixel so as to form the sonically perceivable image comprised of discrete portions of the characteristic variable fluid selectively disposed in either the on state or the off state so that the dolphin having an echolocation system is able to perceive the difference in the on state and off state between the pixels to perceive the image.

9. An apparatus for interspecies communication according to claim 8; further comprising receiving means for receiving acoustic communication signals from an echolocating animal species; and processing means for processing the acoustic communication signals to produce the display driving signals in response thereto.

10. A method of interspecies communication using the apparatus according to claim 9, the method comprising the steps of;

introducing a control object to be perceived by the echolocating animal species;

receiving communication signals by the receiving means from the echolocating animal species in response to the perception of the control object;

processing the communication signals by the processing means to produce the display driving signals;

controlling the display means by the controlling means so that the display means displays the sonically detectable communicable symbols dependent on the communication signals so that the echolocating animal species may perceive communicable symbols as the sonically perceivable image.

* * * * *